US005948742A

United States Patent [19]

Chang et al.

[11] Patent Number: 5,948,742

[45] **Date of Patent: *Sep. 7, 1999**

[54] AEROSOL HARD SURFACE CLEANER WITH ENHANCED BATHROOM SOIL REMOVAL

[75] Inventors: Jennifer Chang, Palo Alto; Maria G. Ochomogo, Danville; Wayne B. Scott, Walnut Creek; Michael H. Robbins, Pleasanton, all of Calif.

[73] Assignee: The Clorox Company, Oakland, Calif.

[ * ] Notice: This patent is subject to a terminal disclaimer.

[21] Appl. No.: 09/059,538

[22] Filed: Apr. 13, 1998

Related U.S. Application Data

[63] Continuation-in-part of application No. 08/632,041, Apr. 12, 1996, Pat. No. 5,814,591, application No. 08/731,653, Oct. 17, 1996, and application No. 08/827,546, Mar. 28, 1997.

[51] Int. Cl.[6] ..... C11D 1/835

[52] U.S. Cl. ..... 510/191; 510/237; 510/238; 510/384; 510/434; 510/470; 510/490; 510/504; 134/198

[58] Field of Search ..... 510/191, 237, 510/238, 384, 434–470, 490, 504; 134/198

[56] References Cited

U.S. PATENT DOCUMENTS

H269 5/1987 Malik ..... 422/37

4,749,516 6/1988 Brusky ..... 252/546

5,380,454 1/1995 Griepenburg et al. ..... 252/174.14

*Primary Examiner*—John R. Hardee

*Attorney, Agent, or Firm*—Mark E. Baze; Joel J. Hayashida

[57] ABSTRACT

An aerosol cleaning composition for hard surfaces is provided with a surprisingly enhanced bathroom soil removal capability. The dispensable includes: (a) an anionic, nonionic, amphoteric surfactant, and mixtures thereof with optionally, a quaternary ammonium surfactant, the total amount of said surfactant being present in a cleaning effective amount; (b) at least one water-soluble or dispersible organic solvent having a vapor pressure of at least 0.001 mm Hg at 25° C., said at least one organic solvent present in a solubilizing—or dispersion—effective amount; (c) a chelating agent selected from the group consisting of tri- or tetrapotassium ethylenediamine-tetraacetate (potassium EDTA), tri- or tetraammonium ethylenediamine-tetraacetate (ammonium EDTA) and mixtures thereof, said chelating agent present in an amount effective to enhance bathroom soil removal in said composition; (d) an effective amount of a propellant; and (e) the remainder, water. The preferred nonionic surfactant is an alkyl polyglycoside which provides a formulation stable to containment within a tin-plated steel can and which also facilitates processing of the composition.

20 Claims, 2 Drawing Sheets

AEROSOL HARD SURFACE CLEANER WITH ENHANCED BATHROOM SOIL REMOVAL

The present application is a continuation-in-part application of U.S. patent applications Ser. No. 08/632,041 now U.S. Pat. No. 5,814,591 filed Apr. 12, 1996, 08/731,653 filed Oct. 17, 1996, and Ser. No. 08/827,546 filed Mar. 28, 1997, each of which are hereby incorporated by reference in their entirety.

FIELD OF THE INVENTION

The present invention relates generally to hard surface cleaners, and more particularly to a chelate-containing aerosol cleaning composition which is especially effective on bathroom soils.

BACKGROUND OF THE INVENTION

A number of hard surface cleaners have been specially formulated to target bathroom soils. These cleaners may include such constituents as surfactants, acidic cleaners, buffers, agents for combating mildew and fungus (e.g., liquid sodium hypochlorite), bacteriostats, dyes, fragrances, and the like in order to provide performance and/or aesthetic enhancements. In addition, such cleaners may contain a chelant or sequestrant in order to assist with the removal of the various soap and mineral deposits (e.g., Ca, Mg, and Fe, etc.) which are found in typical bathroom soils. Hard surface cleaners generally may be applied by pouring, by application with a cloth or sponge, or by spraying in either an aerosol or non-aerosol fashion.

Gipp, U.S. Pat. No. 4,595,527, discloses a laundry prespotter comprising at least 5% by weight of nonionic surfactants and a chelating agent, which includes, among many others, tetrapotassium ethylenediamine-tetraacetate and tetraammonium ethylenediamine-tetraacetate, but which is substantially solvent-free and which does not exemplify tri- or tetrapotassium ethylenediamine-tetraacetate (potassium EDTA) or tri- or tetraammonium ethylenediamine-tetraacetate (ammonium EDTA). This reference fails to teach, disclose or suggest the formulation of an aerosol cleaner with an enhanced bathroom soil removal capability.

Bolan, U.S. Pat. No. 4,207,215, discloses but does not exemplify the use of potassium or ammonium EDTA in a thixotropic gel for tile cleaning. However, the reference neither discloses, teaches or suggests the presence of a solvent, nor discloses, teaches or suggests the formulation of an aerosol cleaner with an enhanced bathroom soil removal capability.

Graubart et al., U.S. Pat. No. 5,454,984, discloses a cleaning composition comprising quaternary ammonium compounds, a mixture of nonionic surfactants, and a glycol ether. The reference further discloses that a chelating agent may be used in the composition and that tetrasodium EDTA is particularly preferred. However, the reference fails to teach, disclose or suggest the use of potassium or ammonium EDTA as a chelant, and further fails to teach, disclose or suggest the formulation of an aerosol cleaner with an enhanced bathroom soil removal capability.

Brusky, U.S. Pat. No. 4,749,516, discloses a laundry prespotter comprising a salt, a mixture of nonionic and anionic surfactants, and a hydrocarbon solvent. The reference discloses but does not exemplify that the salt may include salts of EDTA besides the standard sodium salt, including the potassium, and ammonium salts. However, the reference fails to teach, disclose or suggest the formulation of an aerosol cleaner with an enhanced bathroom soil removal capability.

Malik, H269, discloses a disinfectant cleaning composition comprising a quaternary ammonium halide compound and a glycoside surfactant, including alkyl polyglycosides. The reference discloses but does not exemplify that, optionally, a water soluble detergent builder may be incorporated into the composition, including the sodium, potassium, lithium, and ammonium salts of EDTA. However, the reference fails to teach, disclose or suggest the formulation of an aerosol cleaner with an enhanced bathroom soil removal capability.

Co-pending application Ser. No. 08/507,543 filed Mar. 5, 1998, a continued-prosecution-application of Ser. No. 08/507,543, filed Jul. 26, 1995, now abandoned, of Zhou et al., entitled "Antimicrobial Hard Surface Cleaner," of common assignment, discloses and claims an antimicrobial hard surface cleaner which includes amine oxide, quaternary ammonium compound and tetrasodium EDTA, in which a critical amine oxide:EDTA ratio results in enhanced non-streaking and non-filming performance.

Co-pending application Ser. No. 08/605,822, filed Feb. 23, 1996, of Choy et al., entitled "Composition and Apparatus for Surface Cleaning," of common assignment, discloses and claims a hard surface cleaner which uses a dual chamber delivery system, one chamber containing an oxidant solution and the other, a combination of chelating agents and surfactants.

However, none of the prior art teaches, discloses or suggests the use of potassium EDTA and/or ammonium EDTA as an effective chelating agent with the additional extremely surprising advantage of a greatly enhanced bathroom soil removal capability as compared to other liquid, one-phase cleaners, and especially as compared to those formulated with tetrasodium EDTA. Indeed, all known prior art suggests that the various salts of EDTA (i.e., the potassium, ammonium, and sodium salts, etc.) are interchangeably equivalent with respect to their use as chelants or builders in cleaning compositions. That this is highly incorrect, at least with respect to the cleaning of bathroom type soils, will be clearly demonstrated by experiment later herein, Additionally, none of the art discloses, teaches or suggests an aerosol formulation of a potassium and/or ammonium EDTA-containing cleaning composition.

SUMMARY OF THE INVENTION

Briefly, the present invention is directed to a foam forming aerosol cleaning composition that is particularly suited for cleaning bathroom hard surfaces. The invention is based in part on the quite remarkable and unexpected discovery that formulations of a hard-surface cleaner that include a chelating agent comprised of tri- or tetrapotassium EDTA and/or tri or tetraammonium EDTA afford cleaning compositions that are greatly superior in effecting the removal of bathroom type soil as compared to those containing tetrasodium EDTA, which has been the standard chelant in commercial cleaning compositions.

In one aspect, the invention is directed to a dispensable composition for cleaning hard surfaces that includes:

(a) an anionic, nonionic or amphoteric surfactant, and mixtures thereof with optionally, a quaternary ammonium surfactant, the total amount of said surfactant being present in a cleaning effective amount;

(b) at least one water-soluble or dispersible organic solvent having a vapor pressure of at least 0.001 mm Hg at 25° C., said at least one organic solvent present in a solubilizing—or dispersion—effective amount;

(c) a chelating agent selected from the group consisting of tri- or tetrapotassium ethylenediamine-tetraacetate (potassium EDTA), tri- or tetraammonium ethylenediamine-tetraacetate (ammonium EDTA), and mixtures thereof, said chelating agent present in an amount effective to enhance bathroom soil removal in said composition;

(d) an effective amount of a propellant; and (e) the remainder, water.

In another aspect, the invention is directed to a composition as just described in which the surfactant is a member of the glycoside class of compounds and which composition is especially stable to containment within a tin-plated, steel can. In this aspect, the invention includes:

(a) a glycoside surfactant, with optionally, a quaternary ammonium surfactant, the total amount of said surfactant being present in a cleaning effective amount;

(b) at least one water-soluble or dispersible organic solvent having a vapor pressure of at least 0.001 mm Hg at 25° C., said at least one organic solvent present in a solubilizing—or dispersion—effective amount;

(c) a chelating agent selected from the group consisting of tri- or tetrapotassium ethylenediamine-tetraacetate (potassium EDTA), tri- or tetraammonium ethylenediamine-tetraacetate (ammonium EDTA), and mixtures thereof, said chelating agent present in an amount effective to enhance bathroom soil removal in said composition;

(d) an effective amount of a propellant; and (e) the remainder, water.

In a further aspect, the invention is directed to a device, for dispensing a composition for cleaning hard surfaces, which includes, a pressurized closed container containing the above-referenced cleaning composition and nozzle means for releasing said composition towards a soiled surface.

It is therefore an object and an advantage of the present invention to provide a cleaning composition which contains potassium EDTA and/or ammonium EDTA to greatly enhance the capability of the composition to remove soil of the type commonly found in bathrooms.

It is another object and another advantage of the present invention to provide a cleaning composition which contains potassium EDTA and/or ammonium EDTA and which is dispensable in aerosol form.

It is a further object and a further advantage of the present invention to provide a cleaning composition which contains potassium EDTA and/or ammonium EDTA and which is stable to containment within a pressurized, tin-plated steel can.

DETAILED DESCRIPTION OF THE INVENTION

Figure 1:
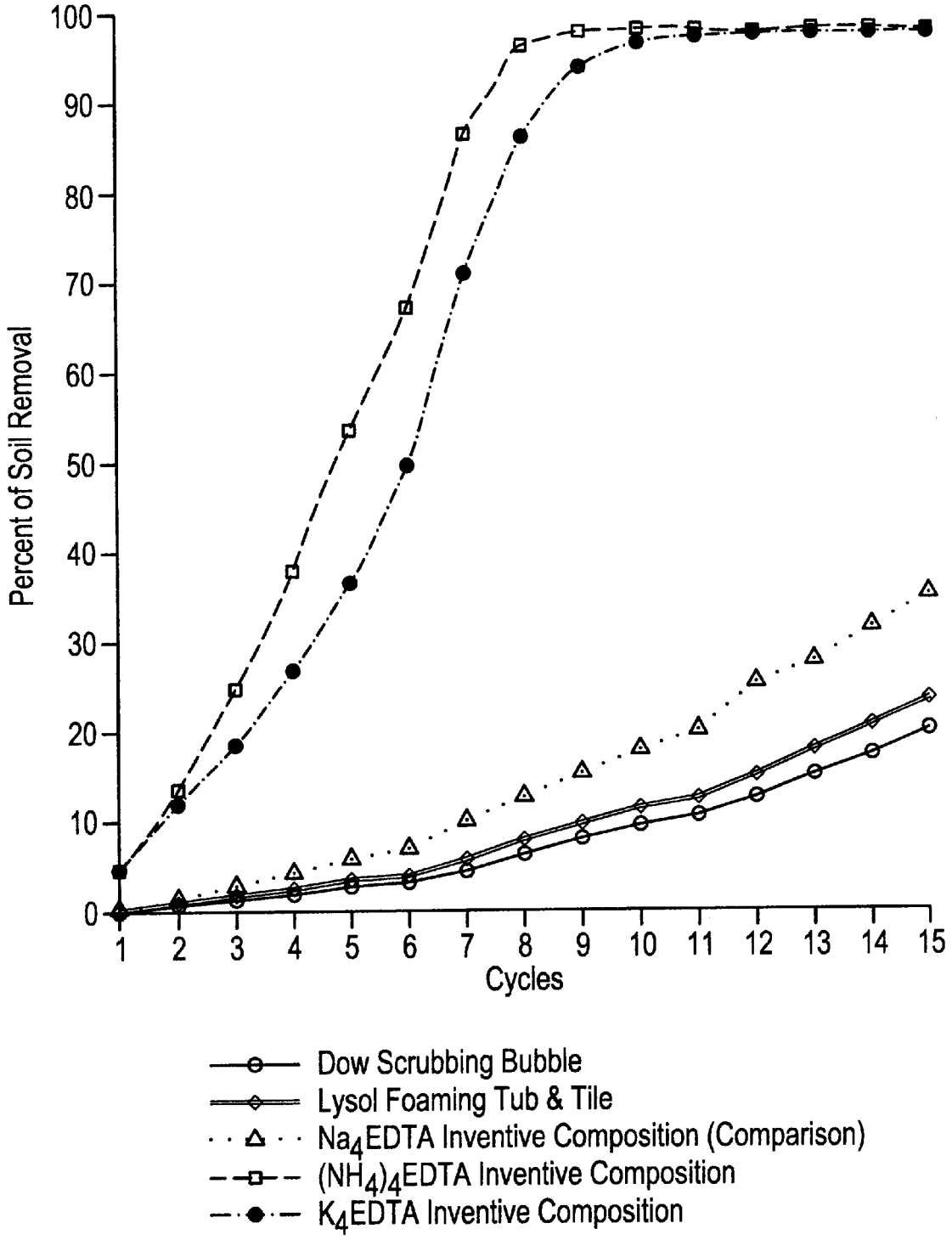
FIG. 1 is a graphical depiction of the bathroom soil removing performances of two formulations according to the inventive compositions, which contain either tetrapotassium or tetraammonium EDTA, but are otherwise identical, as compared to an again otherwise identical composition containing tetrasodium EDTA, and as compared further to two commercial bathroom cleaners.

The invention provides an aerosol formulation comprising an improved, all purpose cleaner especially adapted for the complete and rapid removal of typical bathroom soils which include soap scum, mineral deposits, dirt, and various oily substances from a hard surface. The typical bathroom surface is a bath tub, sink, or shower stall, which may have glass doors, and includes vertical wall surfaces typically made of tile, glass, or composite materials. The inventive cleaner is intended to clean such surfaces, and others, by aerosol application of a metered discrete amount of the cleaner via a dispenser onto the surface to be cleaned. A foaming action facilitates dispersal of the active components. The surface is then wiped, thus removing the soil and the cleaner, with or without the need for rinsing with water.

The aerosol formulation comprises a cleaning composition that is mixed with a propellant. The cleaning composition or cleaner itself, prior to being mixed with the propellant, is preferably a single phase, clear, isotropic solution, having a viscosity generally less than about 100 Centipoise ("cps"). The cleaning composition itself has the following ingredients:

(a) an anionic, nonionic or amphoteric surfactant, and mixtures thereof with optionally, a quaternary ammonium surfactant, said surfactants being present in a cleaning effective amount;

(b) at least one water-soluble or dispersible organic solvent having a vapor pressure of at least 0.001 mm Hg at 25° C., said at least one organic solvent present in a solubilizing—or dispersion—effective amount;

(c) a chelating agent selected from tri- or tetraammonium ethylenediamine-tetraacetate (ammonia EDTA), tri- or tetrapotassium ethylenediamine-tetraacetate (potassium EDTA), and mixtures thereof, said chelating agent present in an amount effective to enhance bathroom soil removal in said cleaner; and (d) the remainder, water.

Additional adjuncts in small amounts such as buffers, fragrances, dyes and the like can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent (based on 100% active) of the cleaning composition.

1. Solvents

The solvent is a water soluble or dispersible organic solvent having a vapor pressure of at least 0.001 mm Hg at 25° C. It is preferably selected from C1–6 alkanols, C1–6 diols, C1–6 alkyl ethers of alkylene glycols and polyalkylene glycols, and mixtures thereof. The alkanol can be selected from methanol, ethanol, n-propanol, "isopropanol," the various positional isomers of butanol, pentanol, and hexanol, and mixtures of the foregoing. It may also be possible to utilize in addition to, or in place of, said alkanols, the diols such as methylene, ethylene, propylene and butylene glycols, and mixtures thereof, and including polyalkylene glycols.

It is preferred to use an alkylene glycol ether solvent in this invention. The glycol ether solvents can include, for example, monoalkylene glycol ethers such as ethylene glycol monopropyl ether, ethylene glycol mono-n-butyl ether, propylene glycol monopropyl ether, and propylene glycol mono-n-butyl ether, and polyalkylene glycol ethers such as diethylene glycol monoethyl or monopropyl or monobutyl ether, di- or tri-polypropylene glycol monomethyl ether, di- or tri-polypropylene glycol monoethyl ether, etc., and mixtures thereof. Preferred glycol ethers are diethylene glycol monobutyl ether, also known as 2-(2-butoxyethoxy) ethanol, sold as Butyl Carbitol by Union Carbide, ethylene glycol monobutyl ether, also known as butoxyethanol, sold as Butyl Cellosolve also by Union Carbide, and also sold by Dow Chemical Co., and propylene glycol monopropyl ether, available from a variety of sources. Another preferred alkylene glycol ether is propylene glycol t-butyl ether, which is commercially sold as Arcosolve PTB, by Arco Chemical Co. Propylene glycol n-butyl ether is also preferred. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. A preferred range is about 1–15%. These amounts of solvents are generally referred to as dispersion effective or solubilizing effective amounts, since the other components, such as surfactants, are materials which are assisted into solution by the solvents. The solvents are also important as cleaning materials on their own, helping to loosen and solubilize greasy soils for easy removal from the surface cleaned.

2. Surfactants

The surfactant may be an anionic, nonionic or amphoteric surfactant, or mixtures thereof. Optionally, a quaternary ammonium surfactant can be added. The following is a nonlimiting description of surfactants which might be employed in the present invention. The description is intended to exemplify that a wide variety of surfactants can be utilized in cleaning compositions variously formulated according to the present invention, the bathroom soil removing capabilities of all of which are remarkably enhanced by the presence of the potassium and/or ammonium EDTA constituent versus tetrasodium EDTA or other chelants.

a. Anionic. Nonionic and Amphoteric Surfactants

The anionic surfactants may generally include, for example, those compounds having an hydrophobic group of C6–C22 (e.g., alkyl, alkylaryl, alkenyl, acyl, long chain hydroxyalkyl, etc.) and at least one water-solubilizing group selected from the group of sulfonate, sulfate, and carboxylate. Preferred are a linear or branched C6–14 alkane sulfonate, alkyl benzene sulfonate, alkyl sulfate, or generally, a sulfated or sulfonated C6–14 surfactant. Examples of these surfactants include Witconate NAS, an 1-octane sulfonate available from Witco Chemical Company; Pilot L-45, a C11.5 alkylbenzene sulfonate (referred to as "LAS") from Pilot Chemical Co.; Biosoft S100 and S130, non-neutralized linear alkylbenzene sulfonic acids (referred to as "HLAS"), and S40, also an LAS, all from Stepan Company; and sodium dodecyl and lauryl sulfates. The use of acidic surfactants having a higher actives level may be desirable due to cost-effectiveness.

The nonionic surfactants may be selected from alkoxylated alcohols, alkoxylated phenol ethers, glycosides, and the like. Trialkyl amine oxides, and other surfactants often referred to as "semi-polar" nonionics, may also be employed.

The alkoxylated alcohols may include, for example, ethoxylated, and ethoxylated and propoxylated C6–16 alcohols, with about 2–10 moles of ethylene oxide, or 1–10 and 1–10 moles of ethylene and propylene oxide per mole of alcohol, respectively. Exemplary surfactants are available from Shell Chemical under the trademarks Neodol and Alfonic, and from Huntsman Chemicals under the trademark Surfonic (e.g., Surfonic L12-6, a C10–C12 ethoxylated alcohol with 6 moles of ethylene oxide, and Surfonic L12-8, a C10–C12 ethoxylated alcohol with 8 moles of ethylene oxide).

The alkoxylated phenol ethers may include, for example, octyl- and nonylphenol ethers, with varying degrees of alkoxylation, such as 1–10 moles of ethylene oxide per mole of phenol. The alkyl group may vary, for example, from C6–16, with octyl- and nonyl chain lengths being readily available. Various suitable products are available from Rohm & Haas under the trademark Triton, such as Triton N-57, N-101, N-111, X-45, X-100, X-102, from Mazer Chemicals under the trademark Macol, from GAF Corporation under the trademark Igepal, and from Huntsman under the trademark Surfonic.

The glycosides, particularly the alkyl polyglycosides, are most preferred as a surfactant for purposes of the aerosol formulation of the present invention. The preferred glycosides include those of the formula:

$$RO(C_nH_{2n}O)_y(Z)_x$$

wherein R is a hydrophobic group (e.g., alkyl, aryl, alkylaryl etc., including branched or unbranched, saturated and unsaturated, and hydroxylated or alkoxylated members of the foregoing, among other possibilities) containing from about 6 to about 30 carbon atoms, preferably from about 8 to about 15 carbon atoms, and more preferably from about 9 to about 13 carbon atoms; n is a number from 2 to about 4, preferably 2 (thereby giving corresponding units such as ethylene, propylene and butylene oxide); y is a number having an average value of from 0 to about 12, preferably 0; Z is a moiety derived from a reducing saccharide containing 5 or 6 carbon atoms (e.g., a glucose, fructose, mannose, galactose, talose, gulose, allose, altrose, idose, arabinose, xylose, lyxose, or ribose unit, etc., but most preferably a glucose unit); and x is a number having an average value of from 1 to about 10, preferably from 1 to about 5, and more preferably from 1 to about 3.

It would be apparent that a number of variations with respect to the makeup of the glycosides are possible. For example, mixtures of saccharide moieties (Z) may be incorporated into polyglycosides. Also, the hydrophobic group (R) can be attached at the 2-, 3-, or 4-positions of a saccharide moiety rather than at the 1-position (thus giving, for example, a glucosyl as opposed to a glucoside). In addition, normally free hydroxyl groups of the saccharide moiety may be alkoxylated or polyalkoxylated. Further, the $(C_nH_{2n}O)_y$ group may include ethylene oxide and propylene oxide in random or block combinations, among a number of other possible variations.

An especially preferred glycoside surfactant is APG 325n, which is manufactured by the Henkel Corporation. APG 325n is a nonionic alkyl polyglycoside in which R is a mixture of C9, C 10 and C11 chains in a weight ratio respectively of 20:40:40 (equivalent to an average of C10.2), with x of 1.6, and an HLB of 13.1.

While it has been found by the inventors that the alkoxylated alcohols and alkyl polyglycosides may both permit the formulation of a composition that is stable and non-corrosive when contained within a pressurized tin-plated steel can of the type commonly used for containment of aerosol formulations, the alkyl polyglycoside is additionally preferred because it does not require an extra heating step to effect a single-phase solution of that ingredient prior to mixing with the remainder of the ingredients. By way of comparison, the ethoxylated alcohol Surfonic L12-6, while having generally favorable stability/corrosiveness characteristics, is a two-phase surfactant which requires heating prior to addition. The related surfactant Surfonic L12-8, on the other hand, is available as a one-phase ingredient, like the alkyl polyglycoside APG 325n, but exhibits generally less favorable stability/corrosion properties. The alkyl polyglycoside affords a surprising combination of stability/non-corrosiveness in an easy to process single-phase surfactant.

Compositions containing other surfactants, such as some amine oxides, tend to be even less compatible with the tin-plated steel can environment (or even with steel cans that are lined with, e.g., an epoxy phenolic coating), becoming unstable and/or causing corrosion of the can (at least not, perhaps, without excessively large amounts of stabilizing agents and/or corrosion inhibitors). Tin-plated steel cans are desirable as containers for aerosol compositions because they are more readily available and are less expensive than aluminum or specially lined steel cans.

The amine oxides, referred to as mono-long chain, di-short chain, trialkyl amine oxides, have the general configuration:

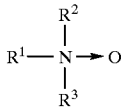

wherein $R^1$ is C6–24 alkyl, and $R^2$ and $R^3$ are both C1–4 alkyl, or C1–4 hydroxyalkyl, although $R^2$ and $R^3$ do not have to be equal. These amine oxides can also be ethoxylated or propoxylated. The preferred amine oxide is lauryl amine oxide. The commercial sources for such amine oxides are Barlox 10, 12, 14 and 16 from Lonza Chemical Company, Varox by Witco and Ammonyx by Stepan Company.

As mentioned above, the amine oxides are less preferred for inclusion in compositions of the present invention where the container for the composition is a tin-plated steel (aerosol) can due to their propensity to cause corrosion and become unstable. However, such compositions when contained, for example, in plastic spray bottles, are stable. Further, such amine oxide-containing compositions exhibit the same remarkable enhancement in soil removing ability due to the presence of the potassium and/or ammonium EDTA as is found when other surfactants are employed (e.g., it was found that compositions of the present invention containing either alkyl polyglycoside, alkoxylated alcohol, or amine oxide all exhibit approximately the same bathroom soil and soap scum removal performances).

A further semi-polar nonionic surfactant is alkylamidoalkylenedialkylamine oxide. Its structure is shown below:

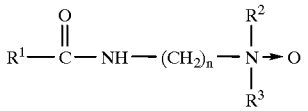

wherein $R^1$ is C5–20 alkyl, $R^2$ and $R^3$ are C1–4 alkyl,

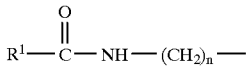

or $—(CH_2)_p—OH$, although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole). This surfactant is available from various sources as a cocoamidopropyldimethyl amine oxide; it is sold by Lonza Chemical Company under the brand name Barlox C. Additional semi-polar surfactants may include phosphine oxides and sulfoxides.

The amphoteric surfactant is typically an alkylbetaine, an amidobetaine, or a sulfobetaine. One group of preferred amphoterics are alkylamidoalkyldialkylbetaines. These have the structure:

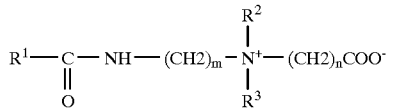

wherein $R^1$ is C6–20 alkyl, $R^2$ and $R^3$ are both C1–4 alkyl, although R2 and R3 do not have to be equal, and m can be 1–5, preferably 3, and n can be 1–5, preferably 1. These alkylbetaines can also be ethoxylated or propoxylated. The preferred amidobetaine is cocoamidopropyldimethyl betaine, available from Lonza Chemical Co. as Lonzaine CO. Other vendors are Henkel KGaA, which provides Velvetex AB, and Witco Chemical Co., which offers Rewoteric AMB-15, both of which products are cocobetaines.

The amounts of surfactants present are to be somewhat minimized, for purposes of cost-savings and to generally restrict the dissolved actives which could contribute to leaving behind residues when the aerosol is applied to a surface. However, the amounts added are generally about 0.001–15%, more preferably 0.002–3.00% surfactant. These are generally considered to be cleaning-effective amounts. If a mixture of anionic and nonionic or amphoteric surfactants is used, the ratio of the anionic surfactant to the nonionic or amphoteric surfactant is about 20:1 to 1:20, more preferably about 10:1 to 1:10.

b. Quaternary Ammonium Surfactant

The invention may further optionally include a cationic surfactant, specifically, a quaternary ammonium surfactant. These types of surfactants are typically used in bathroom cleaners because they are generally considered "broad spectrum" antimicrobial compounds, having efficacy against both gram positive (e.g., Staphvlococcus sp.) and gram negative (e.g., *Escherischia coli*) microorganisms. Thus, the quaternary ammonium surfactant, or compounds, are incorporated for bacteriostatic/disinfectant purposes and should be present in amounts effective for such purposes.

The quaternary ammonium compounds are selected from mono-long-chain, tri-short-chain, tetraalkyl ammonium compounds, di-long-chain, di-short-chain tetraalkyl ammonium compounds, trialkyl, mono-benzyl ammonium compounds, and mixtures thereof. By "long" chain is meant about C6–30 alkyl. By "short" chain is meant about C1–5 alkyl, preferably C1–3. Preferred materials include the BTC 2125 series from Stepan, which comprises di-C24-dialkyl ammonium chloride, and the Barquat and Bardac series, such as Bardac MB 2050, from Lonza Chemical. Typical amounts of the quaternary ammonium compound range from preferably about 0–5%, more preferably about 0.001–2%.

3. Chelating Agent

The chelating agent comprises tri- or tetrapotassium ethylene diaminetetraacetate (referred to as "potassium EDTA" herein), tri- or tetraammonium ethylenediamine tetraacetate (referred to as "ammonium EDTA" herein), or mixtures thereof. The chelating agent is a critical part of the invention.

Its use, in place of what has been the standard chelating agent in the field, i.e., tetrasodium EDTA, results in what can only be termed an amazing enhancement in the efficiency with which bathroom soils are removed.

The fact that the potassium and/or ammonium salts of EDTA are so effective versus the tetrasodium salt is completely unexpected since, in all the known literature, neither the potassium nor the ammonium salts have ever been disclosed or suggested to be superior performers as compared to the tetrasodium salt with respect to their incorporation into any cleaning composition. Indeed, as mentioned previously, all of the known prior art in the cleaning field appears to teache or suggest that these salts are interchangeably equivalent. The inventors have now found, that at least with respect to the removal of various soils having characteristics such as are common to bathroom soils, that this is highly incorrect. The remarkable superiority of the potassium and/or ammonium salts over the tetrasodium salt with respect to the cleaning of bathroom soils is clearly shown in the EXPERIMENTAL section later herein. (As is also shown in the EXPERIMENTAL section, the performance of tetrasodium EDTA versus potassium or ammonium EDTA is rather more comparable with respect to the removal of "pure" soap scum; however, the bathroom soil mixture tested, which contains a number of other materials in addition to soap scum, is more likely to approximate the type of soil that the typical consumer will actually encounter when cleaning a bathroom, and it is this type of material that the present invention excels in removing.)

It should be noted that, as between potassium EDTA and ammonium EDTA, the former is more advantageous in that it has comparatively low or no odor. Further, even though tripotassium EDTA shows somewhat better formulation stability over tetrapotassium EDTA, the latter is preferred for cost reasons, tripotassium EDTA being somewhat more expensive. (Compositions containing either the tri- or tetrapotassium salts were found to compare similarly in their cleaning ability with respect to bathroom soil.)

The potassium EDTA can favorably be prepared by taking the acid form of EDTA and neutralizing it with KOH in a stoichiometric quantity. For example, to 50 g of the acid form of EDTA and 47 g deionized water, 76 g of KOH solution (45%) can be slowly added, resulting in a 46% $K_4$EDTA solution. The acid form of EDTA can be obtained from Hampshire Chemicals and from Aldrich Chemicals. In the neutralization of the acid form of EDTA, it is preferred to use an excess of alkali. Thus, for example, the level of KOH can vary from a stoichiometric quantity to from about a 0 to 5% excess.

The amount of ammonium EDTA and/or potassium EDTA added should be in the range of 0.01–25%, more preferably 1–10%, by weight of the cleaner. If desired, a discrete quantity of a co-chelant (e.g., tetrasodium EDTA), may be used in an amount ranging from about 1–5%.

4. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is preferred.

Small amounts of adjuncts can be added for improving cleaning performance or aesthetic qualities of the cleaner. For example, buffers can be added to maintain a constant pH (which for the invention is between about 7–14, more preferably between about 8–13; formulations containing the tripotassium and/or triammonium salts will naturally be at a lower end of the range as compared to the corresponding tetra salts). These buffers include, for example, NaOH, KOH, $Na_2CO_3$, and $K_2CO_3$ as alkaline buffers, and phosphoric, hydrochloric, sulfuric, and citric acids as acidic buffers, among others. KOH is a preferred buffer since, in the invention, one manner of obtaining potassium EDTA is to take the acid form of EDTA and neutralize it with an appropriate amount of KOH. Builders, such as phosphates, silicates, and carbonates, may be desirable. Further solubilizing materials, such as hydrotropes (e.g., water soluble salts of low molecular weight organic acids such as the sodium or potassium salts of cumene-, toluene-, benzene-, and xylene sulfonic acid), may also be desirable. Adjuncts for cleaning include additional surfactants, such as those described in *Kirk-Othmer, Encyclopedia of Chemical Technology,* 3rd Ed., Volume 22, pp. 332–432 (Marcel-Dekker, 1983), and *McCutcheon's Soaps and Detergents* (N. Amer. 1984), which are incorporated herein by reference. Aesthetic adjuncts include fragrances or perfumes, such as those available from Givaudan, IFF, Quest, Sozio, Firmenich, Dragoco and others, and dyes or colorants which can be solubilized or suspended in the formulation, such as diaminoanthraquinones. Water-insoluble solvents may sometimes be desirable as added grease- or oily soil-cutting agents. These types of solvents include tertiary alcohols, hydrocarbons (e.g., alkanes), pine-oil, d-limonene and other terpenes and terpene derivatives, and benzyl alcohols. Thickeners, such as calcium carbonate, sodium bicarbonate, aluminum oxide, and polymers, such as polyacrylate, starch, xanthan gum, alginates, guar gum, cellulose, and the like, may be desired additives. The use of some of these thickeners (e.g., $CaCO_3$ or $NaHCO_3$) is to be distinguished from their potential use as builders, generally by particle size or amount used.

As already noted above, the preferred container for dispensing of the present composition in aerosol form is a tin-plated steel can. Therefore, it is advantageous to add one or more corrosion inhibitors to prevent or at least reduce the rate of expected corrosion of such a metallic dispenser. Quaternary ammonium surfactants, if present, can cause corrosion. Further, the potassium salt of EDTA appears to have a more corrosive effect on metal containers than the tetrasodium salt. Preferred corrosion inhibitors include, for example, amine neutralized alkyl acid phosphates, amine neutralized alkyl acid phosphates and nitroalkanes, amine neutralized alkyl acid phosphates and volatile amines, diethanolamides and nitroalkanes, amine carboxylates and nitroalkanes, esters, volatile silicones, amines and mixtures thereof. Specific inhibitors include, for example, sodium lauroyl sarcosinate, available from Stepan Company under the trademark Maprosyl 30, sodium meta silicate, sodium or potassium benzoate, triethanolamine, and morpholine. When employed, the corrosion inhibitor preferably comprises about 0.1% to 5% of the aerosol formulation.

5. Propellant

The cleaning composition is delivered in the form of an aerosol. Specifically, in order to apply and build the foam, the cleaning composition is delivered via a gaseous propellant. The propellant comprises, for example, a hydrocarbon, of from 1 to 10 carbon atoms, such as methane, ethane, n-propane, n-butane, isobutane, n-pentane, isopentane, and mixtures thereof. The propellant may also be selected from halogenated hydrocarbons including, for example, fluorocarbons, chlorocarbons, chlorofluorocarbons, and mixtures thereof. Examples of other suitable propellants are found in P. A. Sanders *Handbook of Aerosol Technology* (Van Nostrand Reinhold Co.) (1979) 2nd Ed., pgs. 348–353 and 364–367, which are incorporated by reference herein.

A liquefied gas propellant mixture comprising about 85% isobutane and 15% propane is preferred because it provides sufficient pressure to expel the cleaning composition from the container and provides good control over the nature of the spray upon discharge of the aerosol formulation. Preferably, the propellants comprises about 3% to 30%, more preferably about 3% to 8%, and most preferably about 3% to 6% of the aerosol formulation.

The aerosol formulation is preferably stored in and dispensed from a pressurized can that is equipped with a nozzle so that an aerosol of the formulation can be readily sprayed onto a surface to create a relatively uniform layer of foam. A preferred nozzle is a toggle valve model ST-76 with an orifice size of 0.016 in. (0.4 mm) that is manufactured by Seaquist Perfect Dispensing, Cary, Ill. Dispensers are known in the art and are described, for example, in U.S. Pat. Nos. 4,780,100, 4,652,389, and 3,541,581 which are incorporated by reference herein. Although pressure within the dispenser, i.e., can pressure, does not appear to be critical, a preferred range is about 40 to 58 lbs./in$^2$, more preferably 40 to 50 lbs./in$^2$, and most preferably 40 to 47 lbs./in$^2$ at 700° F. (21° C.).

In loading the dispenser, the non-propellant components of the aerosol formulation are mixed into a concentrate and loaded into the dispenser first. Thereafter, the liquefied gaseous propellant is inserted before the dispenser is fitted with a nozzle.

Experimental

In the following experiments, inventive aerosol formulations identical in every respect except for the use of either the tetrapotassium or tetraammonium salt of EDTA were compared with the same identical formulation containing tetrasodium EDTA and with two commercial bathroom aerosol cleaners, namely, Dow Scrubbing Bubble Bathroom Cleaner (Dow Brands) and Lysol Basin Foaming Tub & Tile Cleaner (Reckitt & Colman), both of which also are believed to employ tetrasodium EDTA as chelant. Table 1 sets forth the active components (including corrosion inhibitors, buffers, etc.) of the inventive cleaning compositions and the tetrasodium EDTA comparison.

TABLE 1

| Ingredients | Active Wt % |
|---|---|
| Alkyl polyglycoside (surfactant) | 1.00% |
| Tetrapotassium, tetraammonium, or tetrasodium EDTA (chelating agent) | 5.00% |
| Diethylene glycol monobutyl ether[1] (solvent) | 4.50% |
| Quaternary ammonium[2] (antimicrobial) | 0.28% |
| Sodium lauroyl sarcosinate[3] (corrosion inhibitor) | 0.6% |
| Potassium benzoate (corrosion inhibitor) | 0.57% |
| Potassium carbonate | 0.15% |
| Fragrance | 0.17% |
| Propellant | 4.5% |
| D.I. water | balance |

[1]Butyl Carbitol (Dow)
[2]BTC 2125M (Lonza)
[3]Maprosyl 30 (Stephan)

Preparation of Bathroom Soil (Protocol I)

A laboratory soil (CSMA No. D-5343-93) combining sebum, dirt and soap scum precipitate was prepared. This is a mixture of potting soil, synthetic sebum (mixture of saturated and unsaturated long chain fatty acids, paraffin, cholesterol and sperm wax, among other materials) and stearate premix (calcium stearate, magnesium stearate and iron stearate). The laboratory soil was applied to pre-baked white tiles and dried in an oven at 75–80° C. for one hour.

Preparation of Simulated Soap Scum (Protocol II)

This laboratory soil (modified from Industry accepted standards) simulates (aged) soap scum and was prepared by making a calcium stearate suspension (ethanol, calcium stearate and water). This soap scum was then sprayed onto black ceramic tiles which were baked at 165–170° C. for one hour, then cooled.

EXAMPLE 1

Visualization Grading for One Coat Removal of Bathroom Soil

This example employs tiles prepared by the method described in Protocol I to which 2.5 grams of the aerosol compositions were applied to each tile. After the foam had dissipated, which typically occurred in about 45 seconds, the tile was wiped with a sponge. The tile was visually graded by a panel of expert graders on a 1 to 10 scale, where 1 indicates no soil removal, while 10 indicates complete removal. The observed results were averaged and subjected to error analysis using Fisher's least significant difference ("LSD"), with a confidence level of 95%. The results are set forth in Table 2. As is apparent, the inventive aerosol formulations containing potassium or ammonium EDTA were greatly superior to the identical formulation containing tetrasodium EDTA and to the two other commercial aerosol cleansers, demonstrating the speed with which the present compositions work.

EXAMPLE 2

Bathroom Soil Removal Scrubbing Test

In this example, a proprietary and automated reader/scrubber was utilized. The reader/scrubber measures % soil removal by calibrating with a clean tile, which would establish 100% clean, versus a completely soiled tile, which would establish a zero % clean. Each soiled tile cleaned by the scrubber is measured during the cleaning by the reader to establish the differences in shading between the initially completely soiled panel and the completely cleaned one. The number of cycles (a cycle represents one combined back and forth movement of the scrubber) to remove 90% of the bathroom soil was measured. Tiles coated with bathroom soil (Protocol I) were used. A total of 9 grams (3×3 grams) of each of the aerosol compositions was applied to a previously wetted sponge on the scrubber. The results are depicted in FIG. 1 and in Table 2 (the tabular results for the tetrasodium EDTA formulation and the competitor formulations were extrapolated from the graphical data). These scores are again within the 95% confidence level. The inventive potassium and ammonium EDTA formulations clearly and unambiguously outperformed the aerosol tetrasodium EDTA and commercial cleaners, demonstrating the cleaning effectiveness of the present compositions.

EXAMPLE 3

Soap Scum Removal Scrubbing Test

Figure 2:
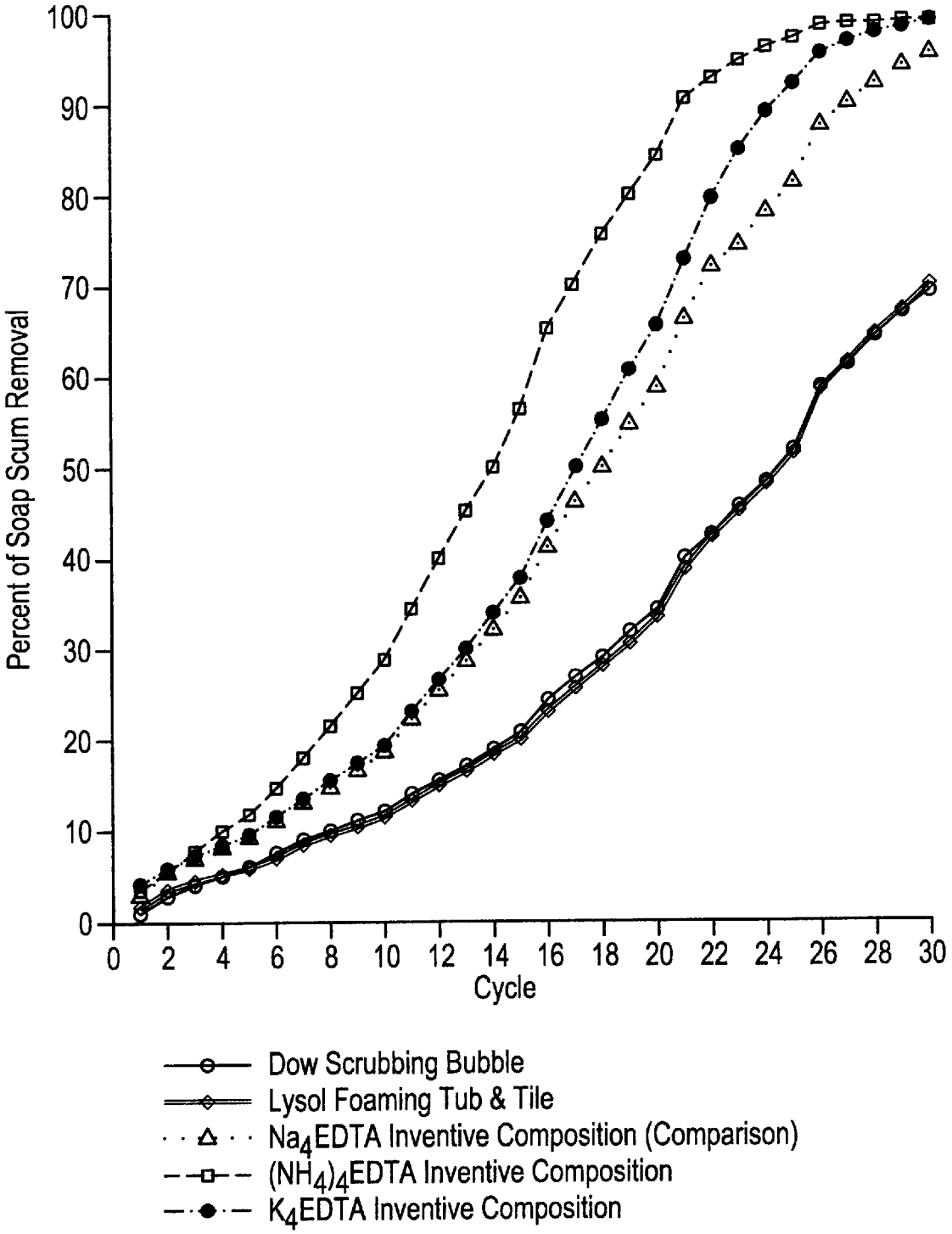
FIG. 2 is a graphical depiction of the soap scum removing performances of two formulations according to the inventive compositions, which contain either tetrapotassium or tetraammonium EDTA, but are otherwise identical, as compared to an again otherwise identical composition containing tetrasodium EDTA, and as compared further to two commercial bathroom cleaners.

In this example, tiles prepared by Protocol II were each coated with a total of 9 grams (3×3 grams) of an aerosol composition and then tested with the reader/scrubber described in Example 2. The number of cycles to remove 90% of the soap scum was measured. The results are depicted in FIG. 2 and in Table 2 (the tabular results for the competitor formulations were extrapolated from the graphical data). These scores are again within the 95% confidence level. The inventive aerosol formulations again clearly outperformed the commercial aerosol cleaners, with less of a difference being seen this time with respect to the formulation identical to the inventive formulation but in which tetrasodium EDTA has been substituted as the chelant. (It should be noted that the soap scum employed for this test is more of a "stress test" for advertising claims purposes, because the layer of soap scum used is a much thicker, more homogeneous or concentrated form of soap scum than would be found in the bathroom as a component of typical bathroom soil.)

TABLE 2

| Product | Ex. 1 Visual Grade (scale from 1 to 10) | Ex. 2 No. of Cycles For 90% Bathroom Soil Removal | Ex. 3 No. of Cycles For 90% Soap Scum Removal |
|---|---|---|---|
| $K_4EDTA$ | 9 | 8 | 25 |
| $(NH_4)_4EDTA$ | 8.7 | 7 | 21 |
| $Na_4EDTA$ | 1.9 | 38 | 29 |
| LYSOL BT&T | 2.6 | 57 | 42 |
| DOW SB | 2.3 | 68 | 41 |

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A dispensable composition for bathroom hard surface cleaning with improved bathroom soil removal comprising:

(a) a glycoside surfactant, with optionally, a quaternary ammonium surfactant, the total amount of said surfactant being present from about 0.001–15%;

(b) no more than 50% of at least one water-soluble or dispersible organic solvent having a vapor pressure of at least 0.001 mm Hg at 25° C.;

(c) 0.01–25% of a chelating agent selected from the group consisting of tri- or tetrapotassium ethylenediamine-tetraacetate (potassium EDTA), tri- or tetraammonium ethylenediamine-tetraacetate (ammonium EDTA), and mixtures thereof;

(d) 3–30% of a propellant; and (e) the remainder, water.

2. The composition of claim 1 wherein said chelating agent comprises potassium EDTA.

3. The composition of claim 1 wherein said glycoside surfactant is an alkyl polyglycoside.

4. The composition of claim 3 wherein said alkyl polyglycoside includes a mixture of C9, C10, and C11 alkyl chain lengths.

5. The composition of claim 1 wherein said organic solvent of (b) is selected from the group consisting of alkanols, diols, polyalkylene glycols, alkyl ethers of alkylene glycols and polyalkylene glycols, and mixtures thereof.

6. The composition of claim 5 wherein said organic solvent is a C3–24 glycol ether.

7. The composition of claim 1 further comprising a quaternary ammonium compound.

8. The composition of claim 1 wherein the quaternary ammonium compound is selected from the group consisting of mono-long-chain, tri-short-chain, tetraalkyl ammonium compounds, di-long-chain, di-short-chain tetraalkyl ammonium compounds, trialkyl, mono-benzyl ammonium compounds, and mixtures thereof.

9. The composition of claim 1 further comprising at least one adjunct selected from the group consisting of builders, buffers, fragrances, perfumes, thickeners, dyes, colorants, pigments, foaming stabilizers, water-insoluble organic solvents, and hydrotropes.

10. A method for removing bathroom soil from a bathroom hard surface, said method comprising the steps of:

(i) forming a foam by delivering an admixture via a propellant, wherein the admixture and propellant are derived from a composition comprising:

(a) a glycoside surfactant, with optionally, a quaternary ammonium surfactant, the total amount of said surfactant being present from about 0.001–15%;

(b) no more than 50% of at least one water-soluble or dispersible organic solvent having a vapor pressure of at least 0.001 mm Hg at 25° C.;

(c) 0.01–25% of a chelating agent selected from the group consisting of tri- or tetrapotassium ethylenediamine-tetraacetate (potassium EDTA), tri- or tetraammonium ethylenediamine-tetraacetate (ammonium EDTA), and mixtures thereof;

(d) 3–30% of a propellant; and (e) the remainder, water; and (ii) applying said foam to a soiled bathroom hard surface.

11. The method of claim 10 further comprising removing said bathroom soil and said admixture from said surface.

12. The method of claim 10 wherein said chelating agent comprises potassium EDTA.

13. The composition of claim 10 wherein said glycoside surfactant is an alkyl polyglycoside.

14. The composition of claim 13 wherein the alkyl polyglycoside includes a mixture of C9, C10, and C11 alkyl chain lengths.

15. The composition of claim 10 wherein said organic solvent of (i)(b) is selected from the group consisting of alkanols, diols, polyalkylene glycols, alkyl ethers of alkylene glycols and polyalkylene glycols, and mixtures thereof.

16. The composition of claim 15 wherein said organic solvent is a C3–24 glycol ether.

17. A device for dispensing a composition for cleaning bathroom soil from a bathroom hard surface which comprises:

(i) a closed container containing said composition which comprises:

(a) a glycoside surfactant, with optionally, a quaternary ammonium surfactant, the total amount of said surfactant being present from about 0.001–15%;

(b) no more than 50% of at least one water-soluble or dispersible organic solvent having a vapor pressure of at least 0.001 mm Hg at 25° C.;

(c) 0.01–25% of a chelating agent selected from the group consisting of tri- or tetrapotassium ethylenediamine-tetraacetate (potassium EDTA), tri- or tetraammonium ethylenediamine-tetraacetate (ammonium EDTA), and mixtures thereof;

(d) 3–30% of a propellant;

(e) the remainder, water; and (ii) nozzle means for releasing said composition towards the hard surface whereupon non-propellant components admix and interact with said propellant to form a foam on said surface.

18. The composition of claim 17 wherein said chelating agent comprises potassium EDTA.

19. The composition of claim 17 wherein said glycoside surfactant is an alkyl polyglycoside.

20. The composition of claim 19 wherein the alkyl polyglycoside includes a mixture of C9, C10, and C11 alkyl chain lengths.

* * * * *